US005927156A

United States Patent [19]

Landwehr, III

[11] Patent Number: 5,927,156

[45] Date of Patent: Jul. 27, 1999

[54] WRENCH WITH SIDE DRIVE MECHANISM

[76] Inventor: John W. Landwehr, III, 2202 Harding, Oak Grove, Mo. 64075

[21] Appl. No.: 08/873,934

[22] Filed: Jun. 12, 1997

[51] Int. Cl.[6] ..... B25B 17/00

[52] U.S. Cl. ..... 81/57.3; 81/57.46

[58] Field of Search ..... 87/57.12, 57.13, 87/57.29, 57.3, 57.46

[56] References Cited

U.S. PATENT DOCUMENTS

| | | | |
|---|---|---|---|
| 4,254,674 | 3/1981 | Strussion et al. . | |
| 4,322,989 | 4/1982 | Garolis | 81/57.26 X |
| 4,374,480 | 2/1983 | Diaz . | |
| 4,825,729 | 5/1989 | Puncochar . | |
| 5,345,845 | 9/1994 | Myers | 81/57.29 |
| 5,540,123 | 7/1996 | Lund . | |

*Primary Examiner*—James G. Smith
*Attorney, Agent, or Firm*—Joseph N. Breaux

[57] ABSTRACT

A wrench with a side drive mechanism that includes a wrench housing assembly having a wrench housing and a housing cover; a rotatable wrench socket, rotatably entrapped by the wrench housing assembly; a rotatable drive socket, rotatably entrapped by the wrench housing assembly; and an elongated worm gear coupling shaft, coupled between the rotatable wrench socket and the rotatable drive socket in a manner such that rotation of the rotatable drive socket causes rotation of the rotatable wrench socket; the rotatable wrench socket having a wrench socket cavity sized to receive a nut, the rotatable drive socket having a drive socket cavity sized to receive the square drive head of a ratchet wrench.

1 Claim, 3 Drawing Sheets

WRENCH WITH SIDE DRIVE MECHANISM

TECHNICAL FIELD

The present invention relates to wrenches and more particularly to a wrench that includes a wrench housing assembly including a wrench housing and a housing cover, a rotatable wrench socket rotatably entrapped by the wrench housing assembly, a rotatable drive socket rotatably entrapped by the wrench housing assembly, and an elongated worm ear coupling shaft coupled between the rotatable wrench socket and the rotatable drive socket in a manner such that rotation of the rotatable drive socket causes rotation of the rotatable wrench socket, the rotatable wrench socket having a wrench socket cavity sized to receive a nut, one rotatable drive socket having a drive socket cavity sized to receive the square drive head of a ratchet wrench.

BACKGROUND OF THE INVENTION

It is often difficult to maneuver a wrench into and back and forth within a tight spot when working on a piece of equipment. It would be a benefit, therefore, to have a wrench with a side drive mechanism that included a wrench socket that could be placed over a nut or bolt head and a side drive mechanism that could be coupled to the drive head of a ratchet wrench to allow the nut or bolt head to be rotated in the desired direction without movement of the wrench housing back and forth within the tight space. In addition, because such a side drive mechanism could require periodic maintenance, it would be a further benefit to have such a wrench that included a removable cover member to allow access to the internal components of the wrench.

SUMMARY OF THE INVENTION

It is thus an object of the invention to provide a wrench with side drive mechanism.

It is a further object of the invention to provide a wrench with side drive mechanism that includes a wrench socket that can be placed over a nut or bolt head and a side drive mechanism that can be coupled to the drive head of a ratchet wrench.

It is a still further object of the invention to provide a wrench with side drive mechanism that includes a removable cover member to allow access to the internal components of the wrench.

It is a still further object of the invention to provide a wrench with side drive mechanism that includes a wrench housing assembly having a wrench housing and a housing cover; a rotatable wrench socket, rotatably entrapped by the wrench housing assembly; a rotatable drive socket, rotatably entrapped by the wrench housing assembly; and an elongated worm gear coupling shaft, coupled between the rotatable wrench socket and the rotatable drive socket a manner such that rotation of the rotatable drive socket causes rotation of the rotatable wrench socket; the rotatable wrench socket having a wrench socket cavity sized to receive a nut, the rotatable drive socket having a drive socket cavity sized to receive the square drive head of a ratchet wrench.

It is a still further object of the invention to provide a wrench with side drive mechanism that accomplishes some or all of the above objects in combination.

Accordingly, a wrench with side drive mechanism is provided. The wrench with side drive mechanism comprises a wrench housing assembly having a wrench housing and a housing cover; a rotatable wrench socket, rotatably entrapped by the wrench housing assembly; a rotatable drive socket, rotatably entrapped by the wrench housing assembly; and an elongated worm gear coupling shaft, coupled between the rotatable wrench socket and the rotatable drive socket in a manner such that rotation of the rotatable drive socket causes rotation of the rotatable wrench socket; the rotatable wrench socket having a wrench socket cavity sized to receive a nut, the rotatable drive socket having a drive socket cavity sized to receive the square drive head of a ratchet wrench.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
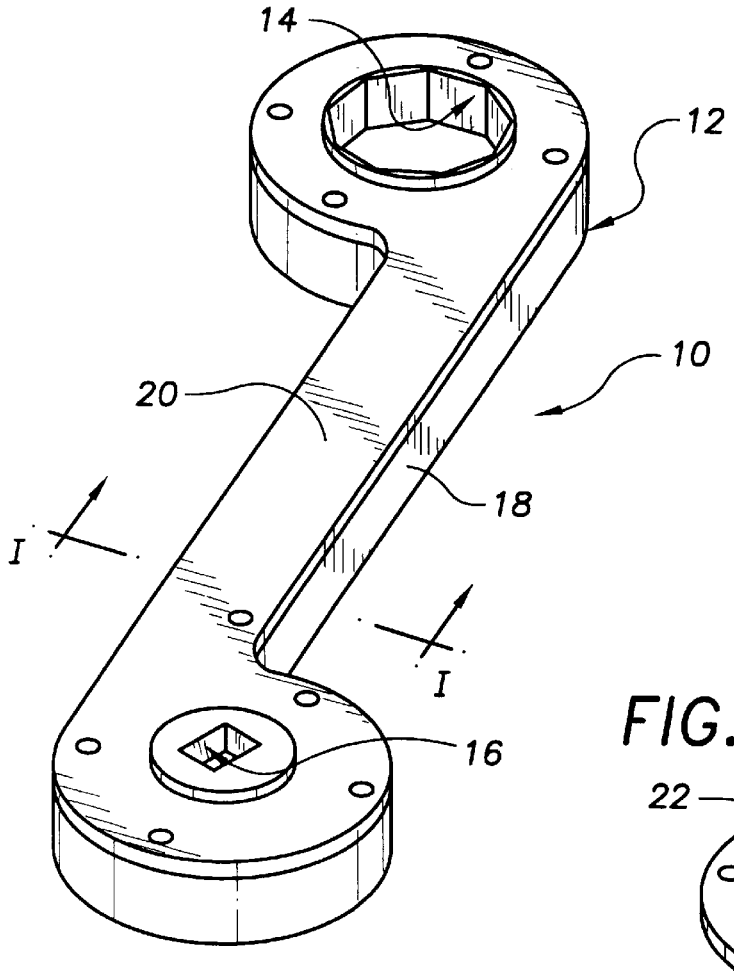
FIG. 1 is a perspective view of an exemplary embodiment of the wrench with side drive mechanism of the present invention showing the rotatable wrench socket, the wrench housing, the wrench housing cover, and the rotatable drive socket.

FIG. 1 shows an exemplary embodiment of the wrench with side drive mechanism of the present invention, generally designated by the numeral 10. In this embodiment, wrench with side drive mechanism 10 includes a wrench housing assembly, generally designated 12; a rotatable wrench socket, generally designated 14; a rotatable drive socket, generally designated 16; and an elongated worm gear coupling shaft, generally designated 17 (FIG. 3).

Figure 2:
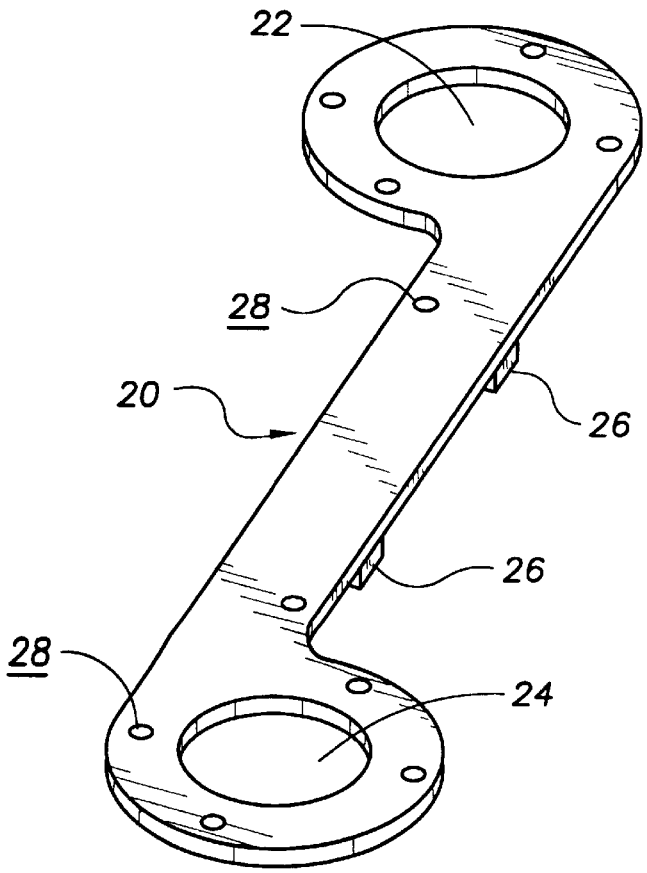
FIG. 2 is a perspective view of the housing cover in isolation showing the wrench socket housing cover rotation guide hole, the drive socket housing cover rotation guide hole, the two bushing hold down structures and the housing cover securing screw holes.

Wrench housing assembly 12 includes a cast metal wrench housing 18 and a cast metal housing cover 20. With reference to FIG. 2, housing cover 20 includes a circular wrench socket housing cover rotation guide hole 22, a circular drive socket housing cover rotation guide noise 24, two bushing hold down structures 26 extending from the underside of housing cover 20 and a number of circular housing cover securing screw holes 28.

Figure 3:
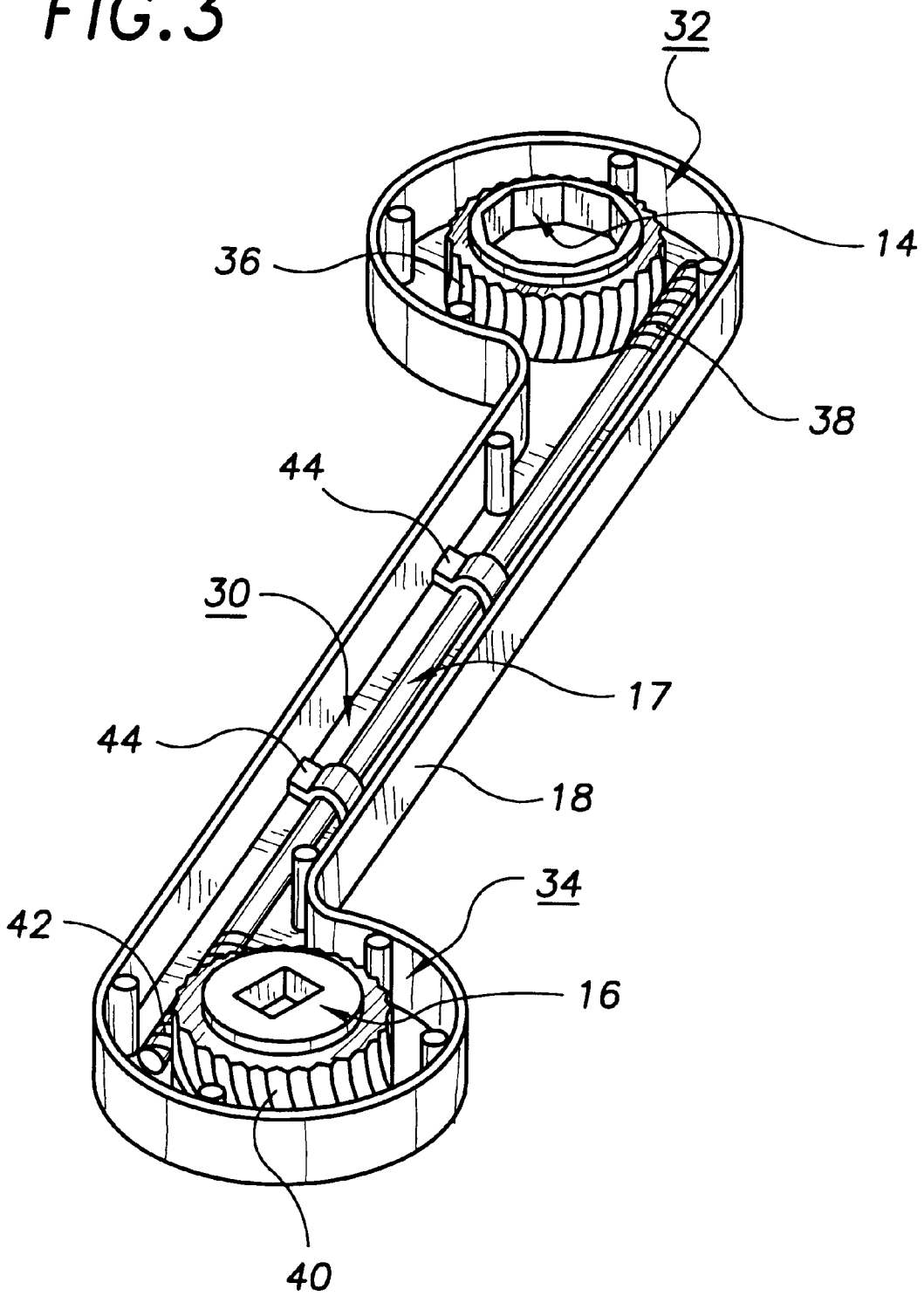
FIG. 3 is a perspective view of the wrench housing of the exempary embodiment of the wrench with side drive mechanism of FIG. 1 with the wrench housing cover removed to show the wrench gear of the rotatable wrench socket coupled to the drive gear of the rotatable drive socket with the elongated worm gear coupling shaft that is held in position within the wrench housing by the two worm gear coupling bushings.

With reference to FIG. 3, wrench housing 18 includes a central worm gear channel portion 30 connected at one end to a wrench socket end cavity portion 32 and at the other end to a drive socket end cavity portion 34. In this embodiment, rotatable wrench socket 14 has a circumferential wrench gear 36 that meshes with one worm geared end 38 of worm gear coupling shaft 17 and rotatable drive socket 16 has a circumferential drive gear 34 that meshes with another worm geared end 42 of worm gear coupling shalt 17. Worm gear coupling shaft 17 is held in position by two worm gear coupling bushings 44. In this embodiment, circumferential wrench gear 36, circumferential drive gear 34, and worm gear coupling shaft 17 are of stainless steel construction.

Figure 3A:
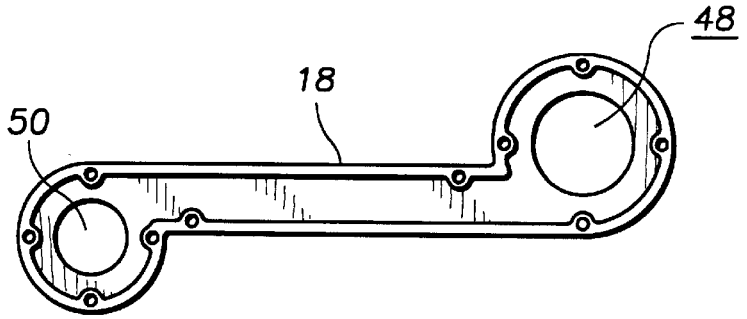
FIG. 3A is a top plan view of the wrench housing of FIG. 3 with the rotatable wrench socket, the rotatable drive socket, the worm gear coupling shaft, and the two worm gear coupling bushings removed to show the wrench socket housing rotation guide hole, the drive socket housing rotation guide hole, and the housing cover securing apertures.

With reference to FIG. 3A, wrench housing 18 includes a circular wrench socket housing rotation guide hole 48 that corresponds in size with circular wrench socket housing cover rotation guide hole 22 (FIG. 2), an a circular drive socket housing rotation guide hole 50 that corresponds in size with a circular drive socket housing cover rotating guide hole 24 (FIG. 2). When housing cover 20 (FIG. 2) is secured to wrench housing 18, circular wrench socket housing rotation guide hole 48 is positioned in concentric registration with circular wrench socket housing cover rotation guide hole 22 (FIG. 2), and circular drive socket housing rotation guide hole 50 is positioned in concentric registration with circular drive socket housing cover rotation guide hole 24 (FIG. 2).

Figure 3B:
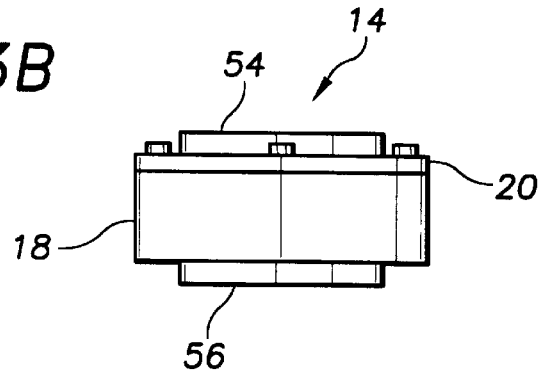
FIG. 3B is a wrench socket end view of the wrench with side drive mechanism of FIG. 1 showing the showing he first cylinder shaped end of the rotatable wrench socket extending through the wrench socket housing cover rotate on guide hole and past he wrench housing cover and the second cylinder shaped end of the rotatable wrench socket extending through the wrench socket housing rotation guide hole and past the wrench housing.
Figure 3C:
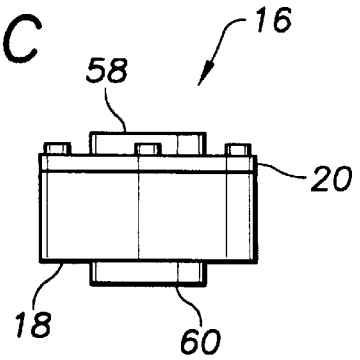
FIG. 3C is a drive socket end view of the wrench with side drive mechanism of FIG. 1 showing the showing the first cylinder shaped end of the rotatable drive socket extending through the drive socket housing cover rotation guide hole and past the wrench housing cover and the second cylinder shaped end of the rotatable drive socket extending through the drive socket housing rotation guide hole and past the wrench housing.

With reference to FIG. 3B, rotatable wrench socket 14 includes a first cylinder shaped wrench socket end 54 that extending through wrench socket housing cover rotation guide hole 22 (FIG. 2) and past wrench housing cover 20 and a second cylinder shaped wrench socket end 56 that extends through wrench socket housing rotation guide hole 48 (FIG. 3A) and past wrench housing 18. With reference to FIG. 3C, rotatable drive socket 16 includes a first cylinder shaped drive socket end 58 that extends through drive socket housing cover rotation guide hole 24 (FIG. 2) and past wrench housing cover 20 and a second cylinder shaped drive socket end 60 that extends through drive socket housing rotation guide hole 50 and past wrench housing 18.

Figure 4:
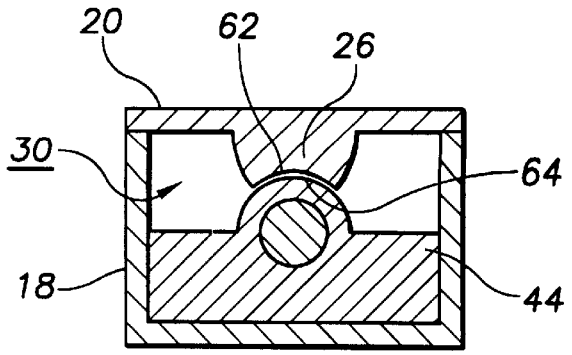
FIG. 4 is a cross-sectional view of the exemplary wrench with side drive mechanism through the line I—I of FIG. 1 showing one of the two identical bushing hold down structures in contact with one of the two identical worm gear coupling bushings.

With reference to FIG. 4, each bushing hold down structure 26 includes a curved portion 62 that contacts a curved surface 64 of a worm gear coupling bushing 44 and holds worm gear coupling bushing 44 in place within central worm gear channel portion 30 (also shown in FIG. 3) of wrench housing 18 when hosing cover 20 is secured to wrench housing 18.

It can be seen from the preceding description that a wrench with side drive mechanism has been provided that includes a wrench socket that can be placed over a nut or bolt head and a side drive mechanism that can be coupled to the drive head of a ratchet wrench; that includes a removable cover member to allow access to the internal components of the wrench; and that includes a wrench housing assembly having a wrench housing and a housing cover; a rotatable wrench socket, rotatably entrapped by the wrench housing assembly; a rotatable drive socket, rotatably entrapped by the wrench housing assembly; and an elongated worm gear coupling shaft, coupled between the rotatable wrench socket and the rotatable drive socket in a manner such that rotation of the rotatable drive socket causes rotation of the rotatable wrench socket; the rotatable wrench socket having a wrench socket cavity sized to receive a nut, the rotatable drive socket having a drive socket cavity sized to receive the square drive head of a ratchet wrench.

It is noted that the embodiment of the wrench with side drive mechanism described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A wrench with side drive mechanism comprising:

a wrench housing assembly having a wrench housing and a removable housing cover having two bushings hold down structures extending from an underside surface of said housing cover each having an inwardly curved bushing receiving curved portion;

a rotatable wrench socket, rotatably entrapped by said wrench housing assembly;

a rotatable drive socket, rotatably entrapped by said wrench housing assembly; and an elongated worm gear coupling shaft, coupled between said rotatable wrench socket and said rotatable drive socket in a manner such that rotation of said rotatable drive socket causes rotation of said rotatable wrench socket, said elongated worm gear coupling shaft having a worm geared wrench socket end and a worm geared drive socket end;

said rotatable wrench socket having a wrench socket cavity sized to receive a nut and a circumferential wrench gear in meshed relationship with said worm geared wrench socket end of said elongated worm near coupling shaft;

said rotatable drive socket having a drive socket cavity sized to receive a square drive head of a ratchet wrench and a circumferential drive near in meshed relationship with said worm geared drive socket end of said elongated worm gear coupling shaft;

said elongated worm gear coupling shaft being partially held in place by a pair of worm gear coupling bushings, each of said pair of worm gear coupling bushings including bushing side end portions, each said bushing side end portion being in contact with an internal sidewall of said wrench housing;

each said worm gear coupling bushing having a curved surface positioned between said bushing side end portions, said curved surface being in restraining contact with a said inwardly curved bushing receiving curved portion of one of said two bushing hold down structures when said housing cover is secured to said wrench housing;

said housing cover having wrench socket housing cover rotation guide hole and a drive socket housing cover rotation guide hole;

said wrench housing including a wrench socket housing rotation guide hole and a drive socket housing rotation guide hole;

said rotatable wrench socket having a first cylinder shaped wrench socket end extending through said wrench socket housing cover rotation guide hole and past said wrench housing cover and a second cylinder shaped wrench socket end extending through said wrench socket housing rotation guide hole and past said wrench housing;

said rotatable drive socket having a first cylinder shaped drive socket end extending through said drive socket housing cover rotation guide hole and past said wrench housing cover and a second cylinder shaped drive socket end extending through said drive socket housing rotation guide hole and past said wrench housing.

* * * * *